US005625392A

United States Patent [19]

Maeda

[11] Patent Number: 5,625,392

[45] Date of Patent: Apr. 29, 1997

[54] IMAGE FORMING DEVICE HAVING A CONTROL ELECTRODE FOR CONTROLLING TONER FLOW

[75] Inventor: Masataka Maeda, Konan, Japan

[73] Assignee: Brother Kogyo Kabushiki Kaisha, Nagoya, Japan

[21] Appl. No.: 205,827

[22] Filed: Mar. 4, 1994

[30] Foreign Application Priority Data

Mar. 9, 1993 [JP] Japan ..... 5-047848

[51] Int. Cl.[6] ..... B41J 2/035; B41J 2/06

[52] U.S. Cl. ..... 347/55

[58] Field of Search ..... 347/55, 111, 112, 347/120, 141, 15, 62, 204, 206, 147, 151; 355/261, 262

[56] References Cited

U.S. PATENT DOCUMENTS 3,689,935 9/1972 Pressman et al. ..... 317/55
5,138,346 8/1992 Muto ..... 347/55
5,216,951 6/1993 Yokoyama et al. ..... 347/206 X
5,357,274 10/1994 Kitamura ..... 347/55

FOREIGN PATENT DOCUMENTS 1-78847 3/1989 Japan ..... 347/15
1-503221 11/1989 Japan .

*Primary Examiner*—Huan H. Tran
*Attorney, Agent, or Firm*—Oliff & Berridge

[57] ABSTRACT

An edge electrode includes a plurality of control electrodes formed on an insulation sheet. The insulation sheet 2 is a 25 μm thick layer of polymide. A recording surface is provided at a thickness side of the insulation sheet. The edge electrode is disposed so that the recording surface is adjacent to toner borne on a toner-bearing roller. A recording edge is provided as a narrow surface of the insulation sheet bordering the recording surface and confronting a back-electrode roller. The control electrodes are formed on the recording edge confronting a recording medium. Each control electrode is formed to about 1 μm thick on the recording edge. The control electrodes are formed at an interval of about 125 μm. The dimension of the control electrodes in the direction following the recording edge is about 100 μm.

23 Claims, 4 Drawing Sheets

IMAGE FORMING DEVICE HAVING A CONTROL ELECTRODE FOR CONTROLLING TONER FLOW

BACKGROUND OF THE INVENTION

1. Field of the Invention

The present invention relates to an image forming device used in, for example, a copier, a printer, a plotter, or a fascimile machine for producing toner images on a recording medium.

2. Description of the Related Art

U.S. Pat. No. 3,689,935 describes a conventional image forming device including a multilayered particle modulator (or aperture electrode), a potential application means, a toner supply means, and a recording medium positioning means. The particle modulator comprises a layer of insulating material, a continuous layer of conductive material (forming a shield electrode) coated on one side of the insulating layer, and a segmented layer of conductive material (forming control electrodes) coated on the other side of the insulating layer. Each segment of the segmented layer is insulatively isolated from each other segment in the layer. At least one row of apertures is formed through the multilayered modulator so that a segment of the segmented conductive layer surrounds each aperture. The control electrodes control according to an image signal applied thereto a flow of toner particles to form a toner image on a recording medium. The potential application means selectively applies a potential between the control electrodes and the shield electrode. The toner supply means supplies toner particles charged so that their flow through the apertures is controlled by the potential applied to the control electrodes. The recording medium positioning means moves the recording medium relative to the aperture electrode and into the path of the toner particle flow.

Japanese Patent Publication Kohyo HEI-1-503221 describes obtaining an image on a recording medium by controlling passage of toner using a matrix of electrodes.

However, there has been known a problem with these conventional image forming devices in that the portion through which toner controlledly passes, i.e., apertures in the case of the aperture electrode and holes in the mesh of the matrix in the case of the aperture matrix, is difficult to form. Also, quality of the toner image can suffer when the toner builds up in the middle of the apertures or mesh holes over a long period of use, so that control of the toner is obstructed. Quality of the image can also suffer when the toner builds up enough to clog the apertures or mesh holes.

SUMMARY OF THE INVENTION

It is therefore, an object of the present invention to overcome the above-described drawbacks by providing an image forming device, for forming images on a recording medium, including a toner supply means, a back electrode, a control device having a control electrode portion, and a recording medium support means.

The toner supply means is for supplying charged toner particles. The back electrode is for producing electric lines of force capable of attracting charged toner particles. The control device is disposed between the toner supply means and the back electrode and within the electric lines of force produced by the back electrode. The control electrode portion is for selectively producing electric lines of force that attract the toner particles supplied by the toner supply device into the electric lines of force produced by the back electrode, thereby controllingly producing a flow of toner particles from the toner supply device toward the back electrode. The control electrode portion is situated at only one side of the flow of toner. The recording medium support means is for supporting the recording medium between the back electrode and the control device in the flow of toner particles so that the flow of toner impinges on the recording medium as controlled by the control device.

BRIEF DESCRIPTION OF THE DRAWINGS

The above and other objects, features and advantages of the invention will become more apparent from reading the following description of the preferred embodiment taken in connection with the accompanying drawings in which:

FIG. 4 (*b*) shows another modification of the edge electrode shown in FIG. 2.

DETAILED DESCRIPTION OF THE PREFERRED EMBODIMENTS

Figure 1:
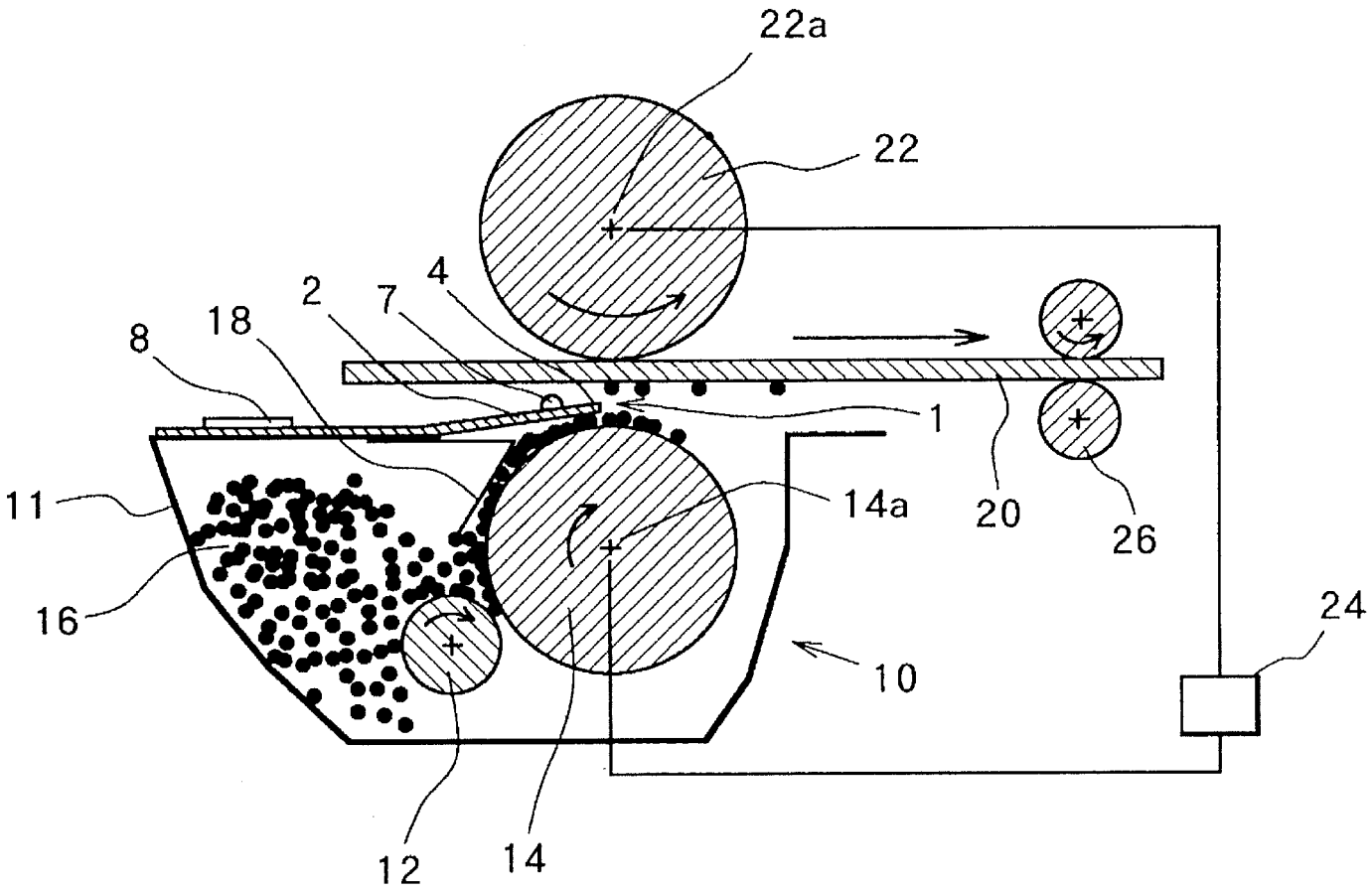
FIG. 1 is a cross-sectional view showing an image forming device according to the present invention.

An image forming device according to a preferred embodiment of the present invention will be described while referring to the accompanying drawings wherein like parts and components are designated by the same reference numerals to avoid duplicating description.

FIG. 1 is a schematic diagram showing an image forming device according to the preferred embodiment. A cylindrical back-electrode roller 22 is rotatably disposed to a housing (not shown) on an axis 22*a* so as to be rotatable in the direction shown by the arrow shown in the cross-section of roller 22 in FIG. 1.

A toner supply device 10 (which acts as a toner supply means) is provided beneath the back-electrode roller 22. The toner supply device 10 includes a toner case 11 (which forms part of the housing) filled with toner 16, a toner-bearing roller 14, a supply roller 12, and a toner layer control blade 18. The toner-bearing roller 14 has a cylindrical shape and is rotatably disposed confronting the back-electrode roller 22 on an axis 14*a* so as to be rotatable in the direction marked by an arrow in FIG. 1. The axis 14*a* of the toner-bearing roller 14 is substantially parallel to the axis 22*a* of the back-electrode roller 22. The supply roller 12 is rotatably disposed in the toner case 11, within the toner 16 therein, and disposed adjacent to the toner-bearing roller 14 so as to be rotatable in the direction marked by an arrow shown in FIG. 1 so as to supply toner 16 to the toner-bearing roller 14 when rotated. The toner layer control blade 18 is disposed adjacent to the toner-bearing roller 14 for adjusting the amount of toner 16 borne on the toner-bearing roller 14 to a layer with a uniform thickness. The toner-bearing roller 14 is therefore for transporting a layer of toner 16 in the direction shown by an arrow in FIG. 1.

A DC power source 24 is connected between the back-electrode roller 22 and the toner-bearing roller 14. The DC power source applies a +1 kV voltage to the back-electrode roller 22 and a 0 V voltage to the toner-bearing roller 14.

An edge electrode 1 (which acts as a control means) is disposed between the back-electrode roller 22 and the toner-bearing roller 14 substantially on only one side of an imaginary plane described by the axis 22*a* of the back-electrode roller 22 and the axis 14*a* of the toner-bearing roller 14. A distance of 0.5 mm separates the back-electrode roller 22 from the upper surface of the edge electrode 1.

Figure 2:
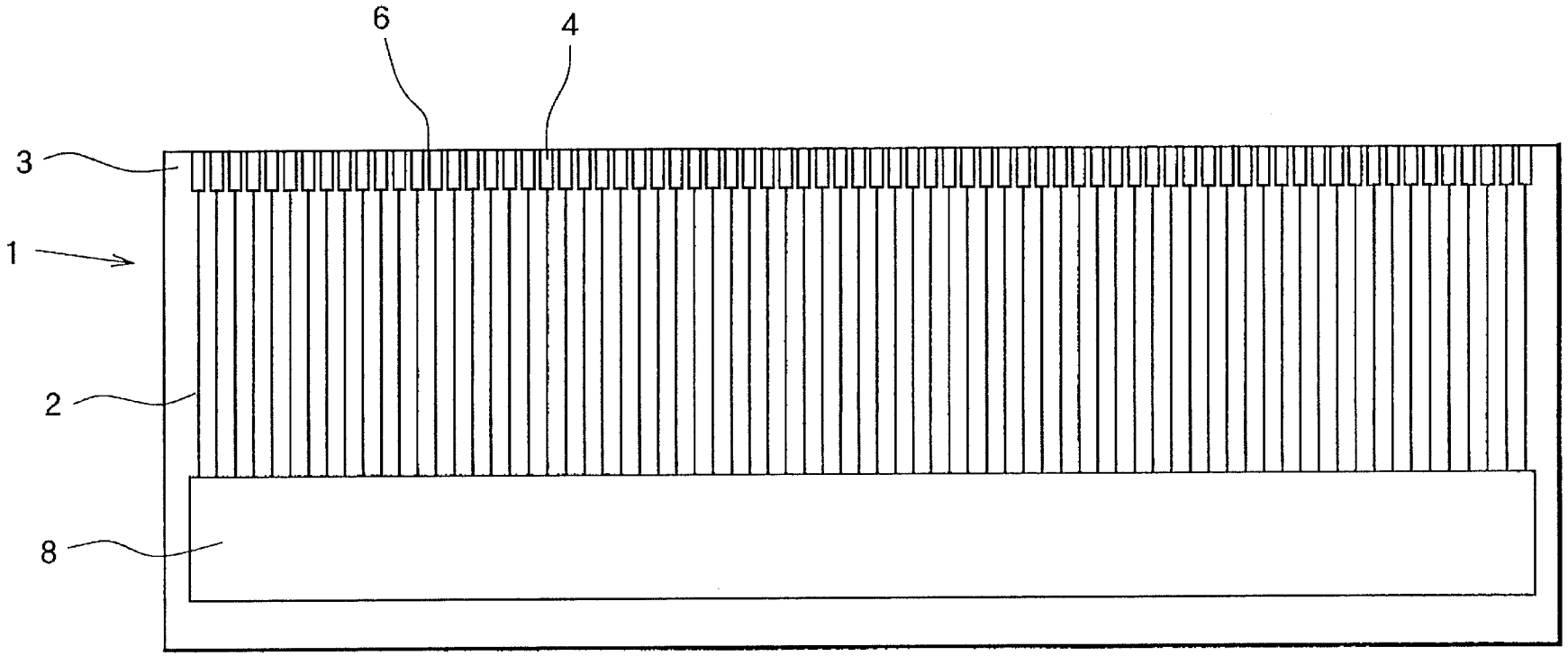
FIG. 2 is an upper view showing details of an edge electrode of the image forming device shown in FIG. 1.
Figure 3:
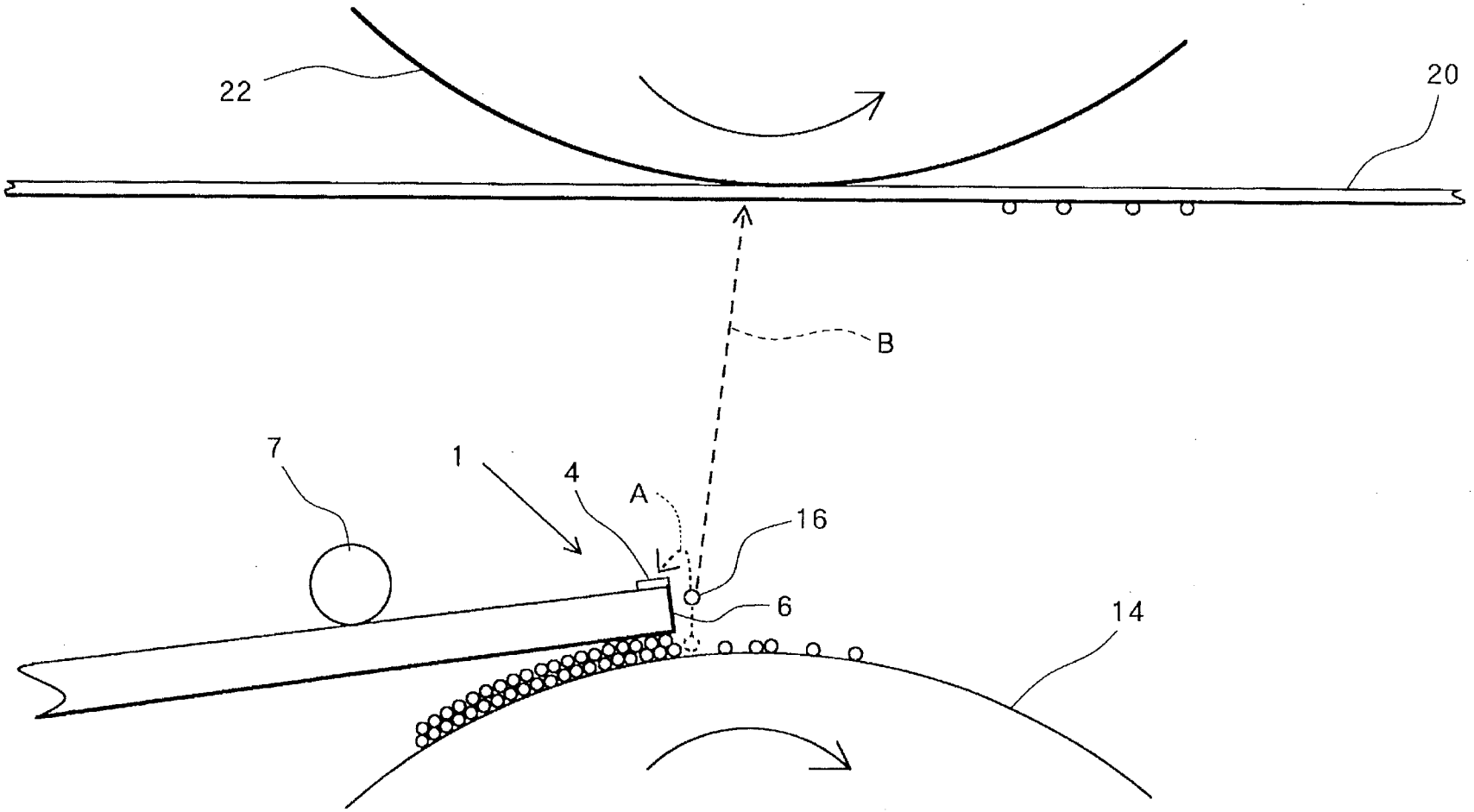
FIG. 3 is a schematic view showing details of the area in the vicinity of the edge electrode shown in FIG. 2.

As shown in FIG. 2, the edge electrode 1 includes a plurality of control electrodes 4 formed on an insulation sheet 2. The insulation sheet 2 is a 25 μm thick layer of polymide. As shown in FIG. 3, a recording surface portion 6 is provided at a thickness side of the insulation sheet 2. As shown in FIGS. 2 and 3, a recording edge 3 is provided as a narrow surface of the insulation sheet 2 bordering the recording surface 6 and confronting the back-electrode roller 22. The recording edge 3 runs in the edgewise direction. The control electrodes 4 are supported on the recording edge 3. The edge electrode 1 is disposed so that the recording edge 3 is substantially parallel to the axis 22*a* of the back-electrode roller 22 and the axis 14*a* of the toner-bearing roller 14*a*. The direction in which the recording edge runs, and is therefore parallel with, will be referred to as an edgewise direction hereinafter.

Each control electrode 4 is formed to about 1 μm thick on the recording edge 3. The control electrodes 4 are formed at an interval of about 125 μm. The dimension of the control electrodes 4 in the edgewise direction is about 100 μm. A control voltage application circuit portion 8 for applying control voltages to the control electrodes 4 is formed on the same surface of the insulation sheet 2 as the recording edge 3, but separated from the recording surface 6. The control voltage application circuit portion 8 selectively applies a 0 V voltage or a +50 V voltage to each control electrode 4 based on an image signal.

As shown in FIG. 3, the edge electrode 1 is disposed so the recording surface 6 of the insulation sheet 2 is positioned adjacent to the layer of toner 16 on the toner-bearing roller 14. A pressing member 7 is provided extending in the edgewise direction in abutment contact with the insulation sheet 2. The pressing member 7 acts as a fulcrum so that the inherent elasticity of the insulation sheet 2 presses the insulation sheet 2 against the layer of toner borne on the toner-bearing roller 14.

A recording medium 20 is supported so as to be transported through the space separating the back-electrode roller 22 and the edge electrode 1 by rotation of the back-electrode roller 22. The recording medium 20 is transported in a direction perpendicular to the edgewise direction. A fixing device 26 is disposed in the path of the recording medium 20 transported by the back-electrode roller 22.

The following text explains the operation of the image forming device constructed as described above.

The toner-bearing roller 14 and the supply roller 12 rotate in the directions as indicated by the arrows in FIG. 1. Toner 16 supplied by rotation of the supply roller 12 picks up a negative charge by rubbing against and being borne on the toner-bearing roller 14. The layer control blade 18 levels the toner 16 born on the toner-bearing roller 14 into a thin layer. Rotation of the toner-bearing roller 14 transports the toner 16 to the edge electrode 1. The toner 16 borne on the toner-bearing roller 14 rubs along the underside of the insulation sheet 2 to then be supplied to the lower side of the recording surface portion 6.

The control voltage application circuit portion 8 selectively applies a +50 V voltage to the control electrodes 4 according to an image signal. As shown in FIG. 3, the electric potential difference between the thus energized control electrode 4 and the toner-bearing roller 14 generates electric lines of force A between the energized control electrode 4 and the toner-bearing roller 14. The electrostatic force in the direction of this high electric potential attracts negatively charged toner 16. The toner 16 separates from the toner-bearing roller 14 and passes along the recording surface 6. Before the toner 16 reaches (comes in contact with) the energized control electrode 4, it enters the lines of electric force B formed between the edge electrode 1 and the recording medium 20 by the voltage applied to the back-electrode roller 22. The toner 16 is attracted to the more powerful electric lines of force B and so hurtles toward the recording medium 20. In this way, a flow of toner 16 is generated between the toner-bearing roller 14 and the back-electrode roller 22 according to an image signal.

According to the present invention, the control electrodes 4 of the edge electrode 1 are positioned on only one side of the flow of toner 16 flowing toward the back-electrode roller 22 from the toner-bearing roller 14. Therefore, the toner controlling portion of the device has no apertures or mesh holes formed therein that can become clogged when the print head is used over long periods. Therefore the toner controlling portion will not clog like in conventional aperture electrodes or matrix-shaped electrodes.

When control electrodes 4 are not involved in image formation, that is, when a dot need not be formed on a corresponding pixel on the recording medium 20, the uninvolved control electrode 4 receives a 0 V voltage from the control voltage application circuit portion 8. Because of this no electric field forms between the control electrode and the toner-bearing roller 14. Toner 16 on the toner-bearing roller 14 is therefore not attracted into the strong electric lines of force formed between the toner-bearing roller 14 and the back-electrode roller 22.

The recording medium 20 is step-fed in a direction perpendicular to the edgewise direction one pixel distance at a time while with each step movement one row of pixels is formed by the toner 16 as controlled by the control electrodes 4. By repeating this process, a toner image is formed on the recording medium 20. Afterward, the toner image is fixed on the recording medium 20 by the fixing device 26.

While the invention has been described in detail with reference to specific embodiments thereof, it would be apparent to those skilled in the art that various changes and modifications may be made therein without departing from the spirit of the invention.

For example, in the above-described embodiment a 0 V voltage is applied to control electrodes 4 not involved in the image forming process (i.e., at pixels where dots are not desired to be formed). However, toner sometimes becomes attached to the recording medium at positions corresponding to uninvolved control electrodes. Applying a negative voltage to uninvolved control electrodes will further reduce the tendency of toner to become attached to corresponding pixels, so that dots are formed only where desired. In this way a better image can be produced.

Figure 4:
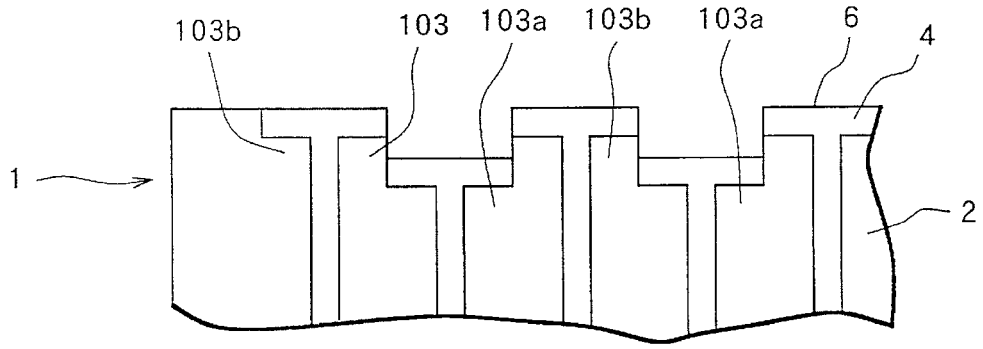
FIG. 4 (*a*) shows a modification of the edge electrode shown in FIG. 2.
Figure 4:
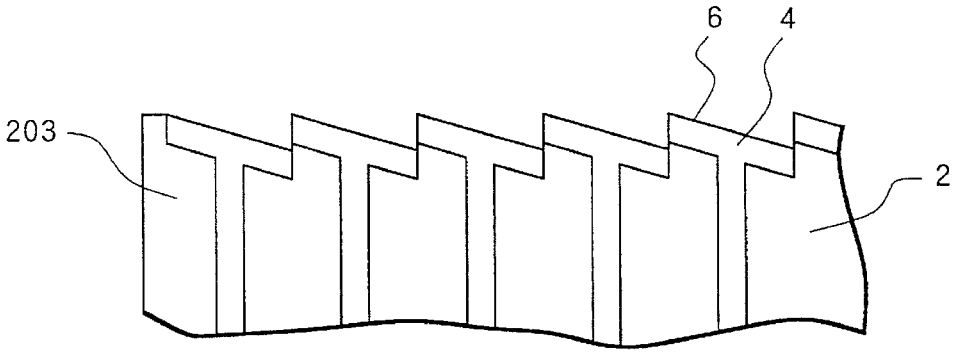

Also, in the above-described embodiment the recording edge 3 of the insulation sheet is formed in a straight-line shape. However, a two-level-shaped recording edge 103 such as shown in FIG. 4 (*a*), or a serrated recording edge 203 such as shown in FIG. 4 (*b*) can be used. As can be seen in FIG. 4 (*a*), the two-level-shaped recording edge 103 is formed with indented areas 103*a* and protruding areas 103*b* in an alternating pattern at the border to the recording surface 6. Indented areas 103*a* are formed substantially aligned on a common axis in the edgewise direction. Similarly, protruding areas 103*b* are substantially aligned along a different common axis in the edgewise direction. However, the indented areas 103*a* and the protruding areas 103*b* are separated in the direction perpendicular to the edgewise direction. Because the indented areas 103*a* and the protruding areas 103*b* are formed at the border of the recording edge 103 and the recording surface 6, the recording surface 6 also is formed with the indented areas 103*a* and protruding areas 103*b*. The control electrodes 4 are formed on the indented areas 103*a* and protruding areas 103*b*.

The serrated recording edge 203 shown in FIG. 4 (*b*) has parallel serrations where the recording edge borders the recording surface 6. The serrations are formed obliquely in relation to the edgewise direction. Electrodes 4 are formed on the serrations where the serrations border the recording surface 6. When the recording medium 20 is transported in a direction perpendicular to the alignment of the control electrodes, recording edges shaped as shown in FIG. 4 (*a*) and 4 (*b*) will insure that adjacent dots are formed on the recording medium sufficiently close together to prevent blank spaces from appearing therebetween.

Figure 5:
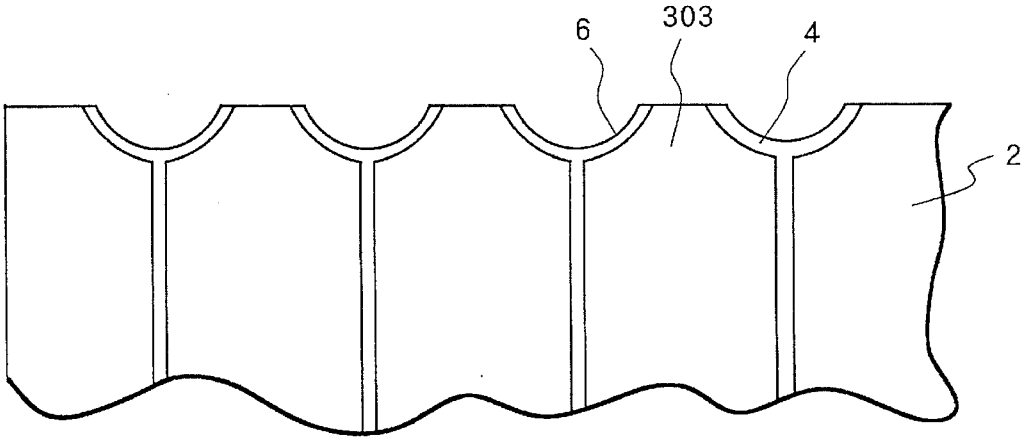
FIG. 5 shows still another modification of the edge electrode shown in FIG. 2.

Additionally, an arc-shaped recording edge 303 as shown in FIG. 5, or otherwise curved-shape recording edge can be provided.

As can be clearly understood by the above explanation, in an image forming device according to the present invention toner flows on only one side of the control portion of the control means. There are therefore no apertures to clog so that high quality images can be outputted over long periods of time.

What is claimed is:

1. An image forming device, for forming images on a recording medium, comprising:

toner supply means for supplying charged toner particles;

a back electrode wherein electric lines of force capable of attracting charged toner particles are produced by applying a voltage to the back electrode;

control means disposed between the toner supply means and the back electrode and within the electric lines of force produced by applying the voltage to the back electrode, the control means having a control electrode portion for selectively producing electric lines of force that attract the toner particles supplied by the toner supply means into the electric lines of force produced by applying the voltage to the back electrode, thereby controllingly producing a flow of toner particles from the toner supply means toward the back electrode, the control electrode portion being situated at only one side of the flow of toner particles;

wherein the recording medium is disposed between the back electrode and the control means in the flow of toner particles so that the flow of toner particles impinges on the recording medium as controlled by the control means.

2. An image forming device as claimed in claim 1, wherein the control means further includes a recording surface along which the flow of toner particles flows;

and wherein the control electrode portion of the control means includes an edge bordering the recording surface and a plurality of electrodes formed substantially along the edge.

3. An image forming device as claimed in claim 2, wherein said control means further includes a layer of insulation material, the layer of insulation material forming at least a portion of the recording surface, and the insulation material forming the edge, the plurality of electrodes being supported by the insulation material.

4. An image forming device as claimed in claim 3 wherein the plurality of electrodes are aligned in a substantially straight line along the edge.

5. An image forming device as claimed in claim 3, wherein said recording medium is transported in a transport direction, and the edge is disposed in an edgewise direction, the edgewise direction being perpendicular to said transport direction of the recording medium.

6. An image forming device as claimed in claim 5 wherein the edge is formed in a two-level shape having indented areas and protruding areas in an alternating pattern where the edge borders the surface, the indented areas being substantially aligned on a common axis in the edgewise direction, the protruding areas being substantially aligned on a different common axis in the edgewise direction, the common axis and the different common axis being separated by a distance in the transport direction, electrodes of the plurality of electrodes being supported on the indented areas and the protruding areas.

7. An image forming device as claimed in claim 5 wherein the edge is formed in a serrated shape, the serrated shape having parallel serrations where the edge borders the surface, the serrations being formed obliquely to the edgewise direction, individual electrodes of the plurality of electrodes being supported on the serrations where the serrations border the surface.

8. An image forming device as claimed in claim 3 wherein the toner supply means includes a toner transport means for transporting the toner particles toward the control means, and a layer regulating means for regulating the toner into a layer on the toner transport means.

9. An image forming device as claimed in claim 8 wherein the back electrode is provided with a cylindrical shape and rotatably supported on an axis;

wherein the toner transport means is provided with a cylindrical shape and rotatably supported on another axis, the another axis being substantially parallel with the axis, a plane with two sides being described by the axis and the another axis;

and wherein the control means is disposed with the edge substantially parallel with the axis and the another axis, and disposed substantially on only one side of the plane.

10. An image forming device, for forming images on a recording medium, comprising:

a toner supply unit for supplying charged toner particles;

a back electrode wherein electric lines of force capable of attracting charged toner particles are produced by applying a voltage to the back electrode;

a control electrode disposed between the toner supply unit and the back electrode and within the electric lines of force produced by applying the voltage to the back electrode, the control electrode having a control electrode portion for selectively producing electric lines of force that attract the toner particles supplied by the toner supply unit into the electric lines of force produced by applying the voltage to the back electrode, thereby controllingly producing a flow of toner particles from the toner supply unit toward the back electrode, the control electrode portion being situated at only one side of the flow of toner particles, wherein the recording medium is disposed between the back electrode and the control electrode in the flow of toner particles so that the flow of toner particles impinges on the recording medium as controlled by the control electrode.

11. An image forming device as claimed in claim 10, wherein the control electrode further includes a recording surface along which the flow of toner particles flows;

and wherein the control electrode portion of the control electrode includes an edge bordering the recording surface and a plurality of electrodes formed substantially along the edge.

12. An image forming device as claimed in claim 11, wherein said control electrode further includes a layer of insulation material, the layer of insulation material forming at least a portion of the recording surface, and the insulation material forming the edge, the plurality of electrodes being supported by the insulation material.

13. An image forming device as claimed in claim 12 wherein the plurality of electrodes are aligned in a substantially straight line along the edge.

14. An image forming device as claimed in claim 12, wherein said recording medium is transported in a transport direction, and the edge is disposed in an edgewise direction, the edgewise being perpendicular to said transport direction of the recording medium.

15. An image forming device as claimed in claim 14 wherein the edge is formed in a two-level shape having indented areas and protruding areas in an alternating pattern where the edge borders the surface, the indented areas being substantially aligned on a common axis in the edgewise direction, the protruding areas being substantially aligned on a different common axis in the edgewise direction, the common axis and the different common axis being separated by a distance in the transport direction, electrodes of the plurality of electrodes being supported on the indented areas and the protruding areas.

16. An image forming device as claimed in claim 14 wherein the edge is formed in a serrated shape, the serrated shape having parallel serrations where the edge borders the surface, the serrations being formed obliquely to the edgewise direction, individual electrodes of the plurality of electrodes being supported on the serrations where the serrations border the surface.

17. An image forming device as claimed in claim 12 wherein the toner supply unit includes a toner transport roller for transporting the toner particles toward the control electrode, and a layer regulating member for regulating the toner into a layer on the toner transport roller.

18. An image forming device as claimed in claim 17 wherein the back electrode is provided with a cylindrical shape and rotatably supported on an axis;

wherein the toner transport roller is provided with a cylindrical shape and rotatably supported on another axis, the another axis being substantially parallel with the axis, a plane with two sides being described by the axis and the another axis;

and wherein the control electrode is disposed with the edge substantially parallel with the axis and the another axis, and disposed substantially on only one side of the plane.

19. An image forming device as claimed in claim 1, wherein the control electrode portion of the control means includes an edge bordering the recording surface and a plurality of electrodes formed substantially along the edge, the edge is disposed in an edgewise direction, adjacent electrodes are contiguous in the edgewise direction.

20. An image forming device as claimed in claim 5, wherein adjacent electrodes are contiguous in the edgewise direction.

21. An image forming device as claimed in claim 6, wherein adjacent electrodes are contiguous in the edgewise direction.

22. An image forming device as claimed in claim 7, wherein adjacent electrodes are contiguous in the edgewise direction.

23. An image forming device as claimed in claim 10, wherein the control electrode portion of the control electrode includes an edge bordering the recording surface and a plurality of electrodes formed substantially along the edge, the edge is disposed in an edgewise direction, and adjacent electrodes ar contiguous in the edgewise direction.

* * * * *